United States Patent [19]

Peck

[11] Patent Number: 4,784,025

[45] Date of Patent: Nov. 15, 1988

[54] NAIL HOLDING DEVICE

[76] Inventor: Ralph R. Peck, Rte. 1, P.O. Box 151, Shubert, Nebr. 68437

[21] Appl. No.: 3,492

[22] Filed: Jan. 15, 1987

[51] Int. Cl.[4] ..... B25C 3/00

[52] U.S. Cl. ..... 81/44; 81/489

[58] Field of Search ..... 81/44, 23, 177.85, 177.1, 81/489, 177.2, 177.5, 124.4, 124.6, 124.7

[56] References Cited

U.S. PATENT DOCUMENTS

| | | | |
|---|---|---|---|
| 601,134 | 3/1898 | Funk | 81/124.4 |
| 2,825,254 | 3/1958 | Peltcher | 81/177.85 |
| 2,849,714 | 9/1958 | Allen | 81/44 |
| 3,338,279 | 8/1967 | Kruttschnitt | 81/44 |
| 4,221,248 | 9/1980 | Rix | 81/44 |
| 4,390,050 | 6/1983 | Whitney | 81/44 |
| 4,422,489 | 12/1983 | Ross | 81/44 |

*Primary Examiner*—Frederick R. Schmidt

*Assistant Examiner*—Bradley I. Vaught

[57] ABSTRACT

A device for aiding nailing of nails into and through the top or peak portions of the corrugations of a corrugated sheet of metal such as tin; a slotted metal block with the bottom side thereof configured to closely overlie and fit over and onto the hill portion of a corrugation of a corrugated metal sheet with the side portions of said bottom side being received down in the valley portions of said sheet on each side of the overlaid corrugation hill portion, with means provided in the slot to there receive and hold in place a nail to be driven through the hill portion of the corrugation and into a roof or wall supporting surface therebelow; a device fitting over and engaging, with the base portion thereof, a corrugation of a corrugated metallic sheet, such device receiving and holding a nail therewithin in order to direct the nail not only into and through the top of the corrugation but perferably additionally at a slight angle from vertical.

10 Claims, 2 Drawing Sheets

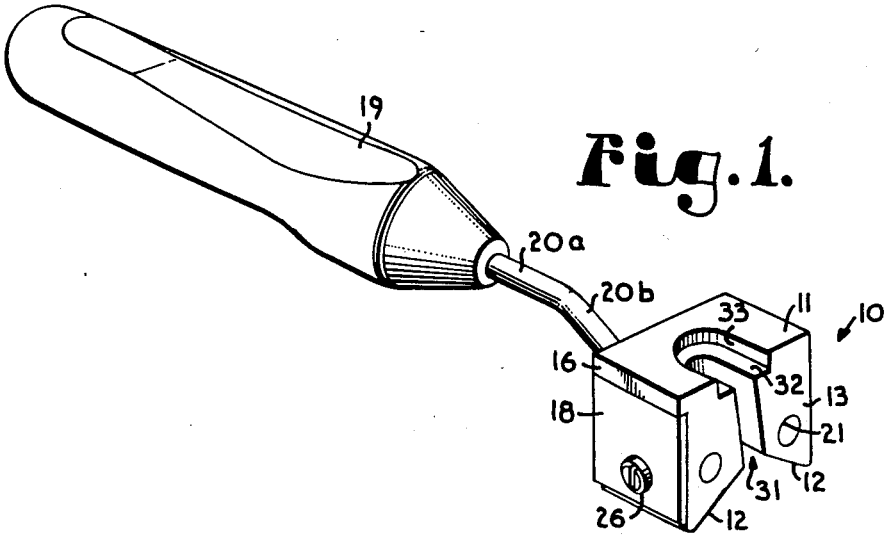
Fig. 1.
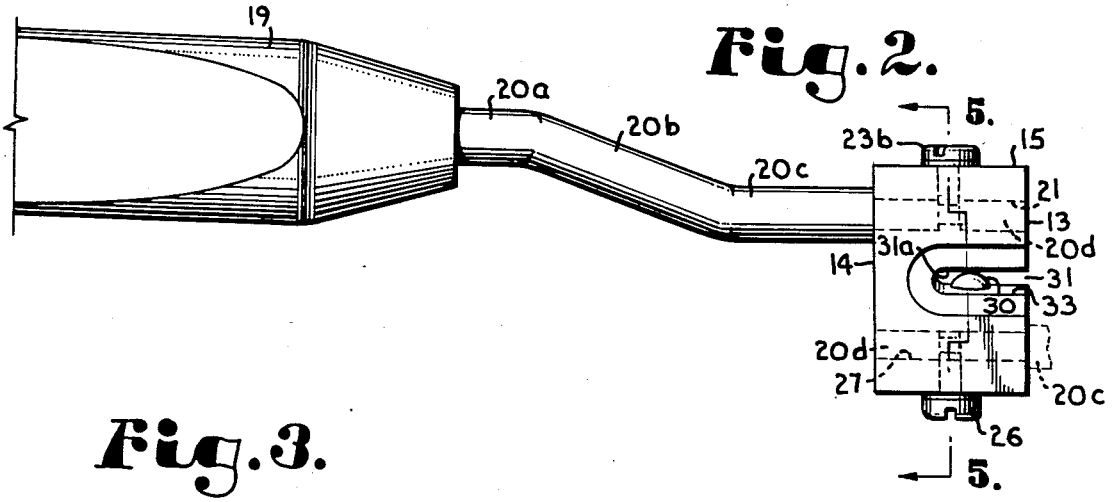
Fig. 2.
Fig. 3.
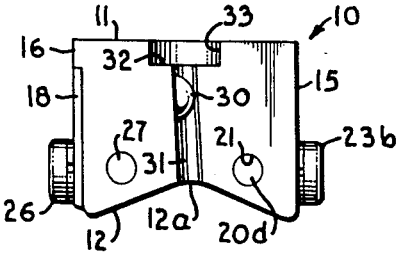
Fig. 4.
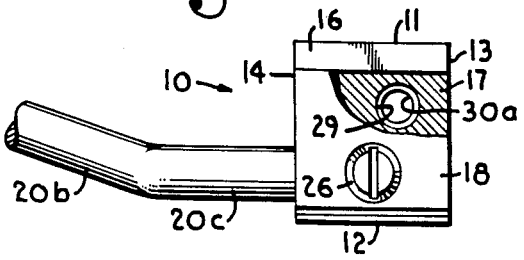

Fig. 5.
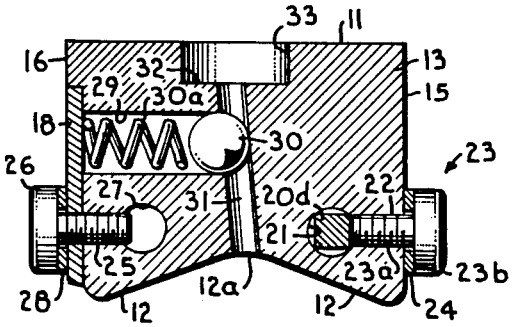
Fig. 6.
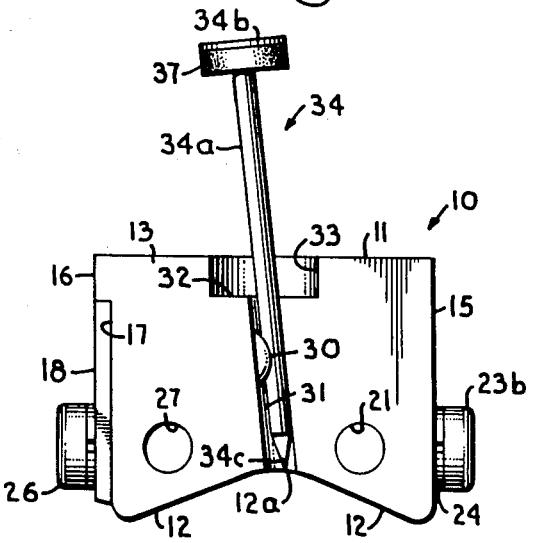
Fig. 7.
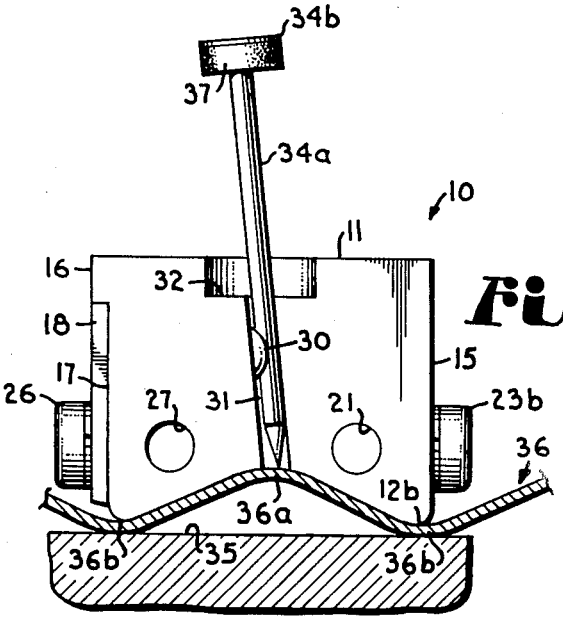
Fig. 8.
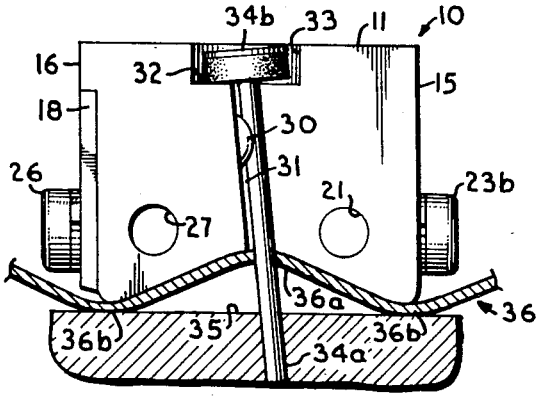
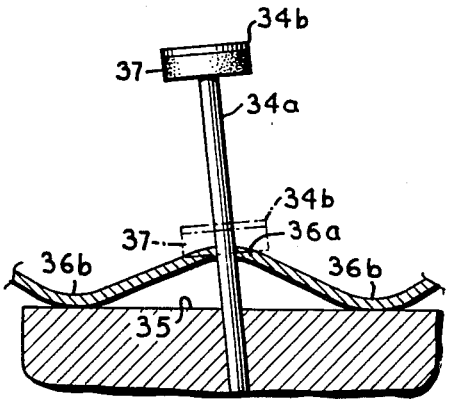
Fig. 9.

NAIL HOLDING DEVICE

BACKGROUND OF THE INVENTION

This invention relates to the problem of nailing corrugated tin panels, sheets or sheathing to roofs, walls or other surfaces which are to be sheathed or covered thereby. Since the enemy of tin is wind, the panels, sheets or sheathings must be firmly nailed to the supporting surface, whether it be an underlying roof construction, vertical wall construction or other structure.

Corrugated tin, like other corrugated sheet material (steel or plastic) has, with respect to the side to which a nail is applied (and the underside thereof), spaced apart hill portions separated by valley portions. The hill portions run substantially parallel to one another as do the valley portions with respect to themselves. Nailing tin sheeting to a surface tends to flatten the hill portions and extend the length of the sheet. When tin is nailed to a surface, the carpenter or roofer applying the nail attempts to start the nail through the very top of a hill portion. Such top is rounded, smooth and may be oily or wet or both. It is only too easy for the operator to smash his fingers or have the nail point slip down the side of the hill portion into a valley next thereto.

Further, when one sheet of tin is lapped at its edge over the edge of another sheet, driving a nail through the doubled corrugation hill portions is twice as difficult, with the two overlapped sheet portions moving with respect to one another due to the nail shock and hammering vibrations. Thus, a device to aid the nailing of corrugated tin sheets to speed up the process and protect the user's fingers, as well as make uniform the point of impact of the nail with respect to the hill portions of the corrugations, is badly needed. Yet further, it is best if the nail is not driven perfectly vertically through the corrugation. That is, it would be best to have a small driving angle from vertical, such as approximately 6°, which will pull the tin sheeting flat to the roof and make a more secure attachment. Trying to provide such an angled driving path without the subject device increases the difficulty of nailing.

THE PRIOR ART

Applicant is aware of the following devices related to implements and devices for driving in nails.

Prangemeier U.S. Pat. No. 827,392 "Implement For Driving In Nails", issued July 31, 1906.

Stingle U.S. Pat. No. 1,087,092 "Staple Holder", issued Feb. 10, 1914;

De Gant U.S. Pat. No. 1,833,456 "Metal Roofing Sheet", issued Nov. 24, 1931;

Mazzola U.S. Pat. No. 2,903,699 "Clamp Nailing Apparatus" issued Sept. 15, 1959;

Arena U.S. Pat. No. 4,037,632 issued July 26, 1977 for "Nail Holding Device";

Yost U.S. Pat. No. 4,179,058, issued Dec. 18, 1979 for "Soffit Nail Set";

Waters U.S. Pat. No. 4,249,297, issued Feb. 10, 1981 for "Nailing Tool And Method Of Nailing";

Whitney U.S. Pat. No. 4,390,050, issued June 28, 1983 for "Tack Pliers"; and

Lawrence U.S. Pat. No. 4,403,725, issued Sept. 13, 1983 for "Nail Holding And Directing Device".

OBJECTS OF THE INVENTION

A first object of the invention is to provide a device which greatly facilitates the nailing of nails into the hill portions of corrugated sheets of tin.

Another object of the invention is to provide a device which fits over and engages, with the base portion thereof, a tin sheet corrugation, the device receiving a nail therein in a slightly angled position or posture, whereby to direct the nail not only into the top of the corrugation, but thereinto at a slight angle which operates to effectively pull the tin sheet flat to the roof and provides a more secure attachment.

Another object of the invention is to provide a device of the character described wherein it is adaptable to use by both left handed and right handed operators, whereby to have maximum utility and versatility.

Another object of the invention is to provide a special nail holder for effectively and safely driving nails through the tops of the ridges of corrugated sheet tin at about a 6° degree angle from the vertical and well into the underlying base structure.

Another object of the invention is to provide such a device wherein initially, the nail to be driven is held by a recessed, spring loaded ball in a socket within a tool having a block or body that fits over the top of a ridge of the corrugated sheet material. After the nail is hammered through the tin sheet ridge into the underlying structure, the nail is removed from engagement by the tool, so that the actual final bonding of the corrugated sheet and the wood roof, side or frame member underlying the same to one another is completed by the hammer alone.

Another object of the invention is to provide a device of the character described which also aids the difficult and hazardous nailing of securing nails through overlapped corrugated tin sheet edge corrugations with less hazard to the user and with less problem of the nail slipping or deviating from the desired path through the overlapping corrugations.

Still another object of the invention is to provide a nail holding and positioning device for driving nails through the hill portions of corrugated sheet tin wherein the nails are sequentially easily placed into the holder of the device, securely held during the initial nailing thereof and then easily disengaged from the device for final driving home after being first driven through the corrugation and part way into the underlying structure.

Yet another object of the invention is to provide such a nail holding device where it is possible for both left handers and right handers to reverse the angle at which the nail penetrates the corrugations on the sheet and roof or wall underneath. Thus, either a left hander or a right hander can transfer the handle of the device (if such is employed) to the opposite side of the corrugation overlying block, thus reversing the nail angle to that most desired.

Still another object of the invention is to provide such a nail holding device which permits use of full force hammer strokes against the top of the nail, driving it through the corrugation and underlying support surface, yet wherein the nail holding device is not trapped or pinned under the head of the nail, thus enabling easy disengagement of the device from the partially driven nail.

Other and further objects of the invention will appear in the course of the following description thereof.

THE DRAWINGS

In the drawings, which form a part of the instant specification and are to be read in conjunction therewith, an embodiment of the invention is shown and, in the various views, like numerals are employed to indicate like parts.

FIG. 1 is a three-quarter perspective view from above of the subject device before it is applied to a corrugated tin roof or before receipt of a nail therewithin to be nailed into and through a corrugated sheet tin roof.

FIG. 2 is a top view of the device of FIG. 1, still without a nail engaged therewithin, the dotted line showing indicating how the handle may be relocated on the positioning block to permit reversed use thereof by a right hander.

FIG. 3 is a front view of the subject device without a nail being engaged therewithin and without the device yet being placed on a hill portion of a corrugation of a panel of corrugated sheet tin. This view is taken from the right hand side of the view of FIG. 2, looking to the left in the view.

FIG. 4 is a side view of the device of FIGS. 1–3, inclusive, taken from the left hand side of FIG. 3, with the plate holding the set screw and retaining the spring and ball in the passageway therefor being cut away at the top to illustrate the passageway receiving the spring and ball.

FIG. 5 is a view taken along the line 5—5 of FIG. 2 in the direction of the arrows.

FIG. 6 is a front view of the device as in FIG. 3 but showing a nail received in the device and captured by the spring loaded ball in the nail receiving slot before application of the device to a corrugated tin roof section.

FIG. 7 is a view like FIG. 6 but showing the device emplaced on the hill portion of a corrugation in a tin sheet roofing section overlying a base structure therebelow.

FIG. 8 is a view like those of FIGS. 6 and 7, showing the later stage and use of the device after FIG. 7 where the nail is driven through the corrugation of the tin sheet and into the roof or wall structure therebelow as far as the nail FIG. 9 shows, in full lines, the nail in its position after removal of the device from the position of FIG. 8 and, in dotted lines, the head of the nail after it has been fully driven into the underlying support section for the corrugated tin sheet.

STRUCTURE OF THE DEVICE

Particularly referring to the first five figures of the drawings, at 10 is generally indicated a metallic block having a top wall 11, a bottom wall 12, a front wall 13 and a rear wall 14. There are also provided two side walls 15 and 16. Side wall 16 has a recessed portion 17 thereof, which recessed portion is adapted to receive a flat plate 18 therewithin Handle 19 is mounted on and fixed to an elongate rod portion generally designated 20, preferably having straight outboard portion **20*a*, upwardly and outwardly angled intermediate portion 20*b* and straight intermediate inboard portion 20*c* from which extends lesser diameter straight portion 20*d*. Portion 20*d* has recessed flat side portions 20*a* intermediate the length thereof to receive the end of a set screw. Portion 20*d* is shown as received within passageway 21 which extends through the block 10 on one side of the upward apex 12*a* of bottom wall 12. In FIG. 5, there is shown internally threaded passageway 22 into which may be threaded the shank 23*a* of set screw 23 which has enlarged head 23*b* and preferably employs lock washer 24 therewith. Set screw 23 abuts the flat side 20*e* of rod portion 20*d* in such manner as to releasably lock same in fixed position in passageway 21** until the set screw is released or loosened.

Still referring to FIG. 5, passageway 25 is internally threaded and receives therewithin the externally threaded shank of set screw 26. The free end of the shank of set screw 26 extends slightly into passage 27 which is equivalent to passage 21, except being on the other side of the apex **12*a* of bottom wall 12. Lock washer 28 is preferably employed with set screw 26. The lower portion of FIG. 2 shows, in dotted lines, how handle 19 may be positioned on the front side of the block 10** for reversed use of the device by a right hander.

Elongate uniform internal diameter cylindrical passageway 29 (FIGS. 4 and 5) extends inwardly from wall portion 17 under plate 18. A ball 30, tensioned (when forced back into passage 29 by insertion of a nail 34 into slot 31) by short spring **30*a*, is positioned at the inboard extremity of passageway 29**, typically with a portion thereof extending past the end of the passageway.

A preferably slightly angled (from vertical) slot 31 having inboard base **31*a* thereof (FIG. 2) extends through the block from the central upper apex 12*a* of bottom wall 12 upwardly to the base 32 of an enlarged U-shaped recess defined by U-shaped wall 33 extending downwardly, substantially vertically from top wall 11 to base 32. A portion of ball 30 typically extends out of passageway 29 into slot 31. The maximum width of slot 31 is preferably equal to or less than the radius of ball 30. Ball 30 and passageway 29 are positioned inwardly of the block 10 sufficiently that a nail 34, as seen in FIGS. 6–9, inclusive, with shank 34*a* and enlarged head 34*b*, as well as point 34*c*, can be inserted back against or down into base wall 31*a* of slot 31 behind ball 30, somewhat compressing ball 30 inwardly in passage 31 against spring 30*a*. That is, that portion of ball 30 which is not forced back into passageway 29 lies against the side and front of nail shank 34*a* thus forcing the nail shank against the opposite wall of slot 31 from that carrying passage 29, while further retaining the nail shank 34*a* in position behind ball 30 against the accurate base 31*a* of slot 31**.

While it is not necessary that metallic block 10 have the precise configuration shown in the views, such is a convenient, easily formed shape involving a flat, normally horizontal top wall 11 having the recess defined by base 32 and normally vertical wall 33 most preferably formed therewithin. Normally vertical front and rear walls 13 and 14 are preferably substantially rectangular in form as is, preferably, top wall 11. Slot or slotted passageway 31 is formed or cut into the front wall 13 and preferably extends at about a 6° angle from the vertical from the apex **12*a* of bottom wall 12 upwardly into the recess in top wall 11. Slot 31 is preferably substantial parallel to side walls 15 and 16, as well as passages 21 and 27. Bottom wall 12 is, on its longitudinal axis from front wall 13 to rear wall 14, upwardly formed accurately to match the configuration of a hill portion of a corrugation of a sheet tin roof or wall panel so as to be able to closely overlie same. The corners or laterally outboard edges of the junctures of bottom wall 12 with side wall portions 15 and 17, as at 2*b***, are preferably rounded as thus seen in FIGS. 3 and 5–8, inclusive, whereby not to cut into, dent or notch the sheet 36 when the nail has been driven through and in to its position of FIG. 8.

OPERATION AND FUNCTION

FIGS. 6–9, inclusive illustrate the manner of use of the device. Thus, in FIG. 6, the shank 34*a* of nail 34 is snapped into or fed down into slot 31 with its pointed tip just at the bottom of slot 31 and a portion of its shank received behind the outermost portion of ball 30. The spring 30*a* is under compression because the diameter of the shank is sufficient to compress ball 30 into passageway 29 against spring 30*a*. At this point, the device is in the operator's or user's hand, initially being held away from the corrugated tin sheet which is being secured to an underlying structure, typically a wall or a roof. Also, before the nail is snapped or pushed in place as seen in FIG. 6, the handle tip 20*d* is received in passageway 21 and set screw 23 tightened down thereagainst. This is the full line position of FIGS. 1, 2 and 4 and provides for the handle to be held in the left hand of the operator while, with the right hand, the operator wields the hammer (not shown). Alternatively, if such right hander wants to or must use the device with the slot angle reversed, the opposite handle insertion position seen in the lower part of FIG. 2 is employed, with extension 20*d* of the handle 19 being received in passageway 27 and the rest of rod 20 extending to the right in FIG. 2, as shown at 20*c*.

For purposes of description and illustration, the device, as seen in FIGS. 2–9, inclusive, is considered to be and described as being used with respect to a horizontal work surface 35 (FIGS. 7–9, inclusive) with a horizontal corrugate sheet 36 being nailed to the body of work surface 35 from above. Surface 35 could be vertical or at any angle. Corrugated sheet 36 has hill portions 36*a* with valley portions 36*b* on each side thereof.

When the block 10 is positioned in use or operating position as seen in FIGS. 7 and 8, the apex 12*a* of bottom wall 12 is placed over the hill portion 36*a* of a corrugation in sheet 36. The width of block 10 is preferably sufficient that the rounded ends 12*b* of the junctures of walls 15 and 17 with bottom wall 12 are received within the lower valley portions 36*b* of sheet 36, resting firmly thereon. Thus, not only does the central congruent configuration of bottom wall 12 fit over the hill portion of the corrugation, but the width of wall 12 and lateral extensions of rounded portions 12*b* also fit partly or fully into the valleys 36*b*, giving a stable base which will not move to the left or right in the view of FIGS. 7 and 8 as the nail is driven. Preferably, the lateral edge bottom portions, including plate 18 (if present) do not extend up the incline of the adjacent hills 36*a* to avoid denting or notching the tin sheet as the nail is driven in.

With the device in position as in FIG. 7, astride a hill portion 36*a* of a corrugation on a tin sheet 36, which sheet is to be fastened to a wall, roof or other work surface 35, the operator then strikes the nail head 34*b*, driving the point 34*c* through the apex or near apex 36*a* of the hill portion of the corrugation. Whether or not the blow is perfectly aligned with the vertical front and back orientation of nail shank 34*a* and its slightly angled lateral position as seen in FIGS. 6–9, inclusive does not make any difference. If the blow tends to move the nail 34 to the right in the view of FIG. 7, the abutment of the left hand lower wall portion 12 against the left hand side of the corrugation prevents motion in that direction. If the blow is directed to the left of center on the longitudinal axis of shank 34*a*, the opposite effect occurs, specifically, the right hand side of lower wall 12 abuts against the right hand (in the view) rising hill portion 36*a* of the corrugation, while the rounded portions 12*b* in the valley portions 36*b* also work against lateral movement. Off angle blows at substantial right angles to those described are generally resisted by ball 30 held against shank 34*a*. Thus, lower shank and lower tip 34*c* of nail 34, initially received in the lower end of slot 31, are driven into and through the apex 36*a* of tin sheet 36 toward work surface 35. One or more following hammer blows will drive the nail head 34*b* down into the recess defined by walls 32 and 33 with the shank 34*a* driven well into wall, roof or work surface 35 as may be seen in the view of FIG. 8. It is not absolutely necessary to have present the recess 32, 33, defined by walls 32 and 33, but such is far preferred in order to be able to drive the nail as far into work surface 35 as possible yet not pinning block 10 to the corrugated sheet. Thus the block 10 is freely removable from under the gasket Once the nail has been driven into the position shown in FIG. 8 (or where the nail head 34*b* would nearly or actually abut the top of wall 11 if the recess were not present), the operator pulls the device 10 axially (with respect to slot 31 (FIG. 2) or away from the viewer in FIG. 8) so that spring loaded ball 30 is further driven against the action of spring 30*a* into passage 29, thus permitting shank 34*a* of nail 34 to snap past ball 30 and move out the front of slot 31 to the right in FIG. 2. The nail stays in its driven position while the block 10 is pulled away from it along the length of the corrugation.

It also should be noted that it is not absolutely necessary to have slot 31 angled in the manner shown in the views, but such is strongly preferred, in order to best pull the tin sheet flat to the roof and provide a more secure attachment thereof. Said otherwise, a truly vertical slot 31 in block 10 with respect to normally horizontal top wall 11 is operable and useful but definitely is not preferred. FIG. 9 shows the final stage of driving the nail 34 home with respect to the corrugated tin sheet 36 and work surface 35. That is, when the device (from the position of FIG. 8) is withdrawn from engagement with shank 34*a*, further blows of the hammer against the head 34*b* of nail 34 drives it down to the position seen in dotted lines in FIG. 9, with gasket 37 abutting against the top of the hill portion 36*a* of sheet 36. The full length of the nail shank 34*a* then is received into the wall, roof or work surface 35, save for that portion under the corrugation apex 36*a*.

It is true that a very badly front or back oriented hammer stroke to the nail head 34*b* may snap the shank 34*a* past ball 30 and not penetrate the corrugation top 36*a*. However, the blow must be quite misdirected to effect such in action. In any case the user's hand is not struck.

To repeat the action, a new nail is merely snapped or pushed into the device in the position of FIG. 6 and the device laid on the adjacent corrugation or a longitudinally displaced interval along the same corrugation. In this manner, the hand of the operator not using the hammer is well protected against misdirected blows of the hammer, sliding of the nail point 34*c* on oily and/or wet tin and the entire operation of nailing the corrugated sheet 36 to the work surface 35 is greatly facilitated, expedited and speeded.

It should be noted that, while walls 13 and 14 are shown as preferably substantially rectangular and parallel to one another, they could be accurate or oval in the view of FIG. 2. Likewise, while walls 15 and 16 are shown as preferably substantially rectangular and opposed to one another and extending at right angles to the front and rear faces 13 and 14, such also could be accurate, as well or of different shape. What is required is a body portion centrally of the block structure which can receive a slot 31 therein and a recess as defined by walls 32 and 33, if such is (preferably) employed. Yet further, there must be a nail shank holding device or means which permits the nail to be snapped back and forth thereacross (or slid up and down therebehind) which yet strongly holds same in nailing position when the nail is received against slot bottom wall 31*a*. Any other equivalent resilient holding means to the spring loaded ball could be used. Bottom wall 12 must be so configured from side wall 15 to side wall 16, 17 (or from two opposed side walls) so as to not only overlie the hill 36*a* of the corrugated sheet but also extend down into the valleys 36*b* on each side thereof, whereby to prevent lateral movement of the block or device 10 if a hammer blow is struck not precisely aligned with the nail shank 34*a*.

Thus there has been provided a device for aiding nailing of nails through the top or peak portions of the corrugations of a corrugated sheet. The corrugated sheet has spaced apart, adjacent, parallel corrugations made up of hill portions 36*a* separated each from the other by a valley 36*b* therebetween, adjacent valleys 36*b* also extending substantially parallel to one another. The device, as seen in the drawings, has a top wall 11 and an opposing bottom wall 12 with two side walls 15 and 16, 17 positioned opposite one another as well as front and rear end walls 13 and 14 positioned opposite one another, all of said walls preferably being substantially rectangular in shape.

The bottom wall 12 is symmetrically inwardly and upwardly formed from the side walls 15 and 16, 17 to the substantial center 12*a* thereof, whereby bottom wall 12 will closely overlie and fit over and onto the hill portion 36*a* of a corrugation of a corrugated sheet 36. The side portions 12*b* of said bottom wall 12 are received down into the valley portions 36*b* on each side of said overlaid corrugation hill portion 36*a*.

A slotted passageway 31 extends substantially vertically through said block from substantially centrally of the top wall 11 to substantially centrally of said bottom wall 12 in the upwardly formed central portion 12*a* of the latter wall. The slotted passageway 31 extends in its entire length through said block 10 and out of the front wall 13 thereof. Means are associated with the slotted passageway 31 intermediate the ends thereof for resiliently engaging a portion of the side of the shank 34*a* of a nail 34, whereby to resiliently and releasably retain the nail in the passageway 31 for driving of said nail into the hill portion 36*a* of a corrugation.

The device preferably has the slotted passageway slanting at an angle approximately 6° from the vertical in its extension through the block with respect to the normally vertical side walls 15 and 16, 17.

The device preferably additionally includes a recess such as that defined by walls 32 and 33 in the top wall of the block surrounding the upper end of slotted passageway 31 and adapted to receive the head 34*b* of a nail 34 partially driven into said corrugated head portion 36*a* and any supporting surface 35 therebeneath.

The resilient engaging means noted can comprise a spring loaded ball 30 in a passageway or socket 29, 29*a*, the ball 30 resiliently biased at least partially out through one side wall of the slotted passageway 31 intermediate the ends thereof and spaced somewhat forwardly of base 31*a* of slot 31.

It should be noted that this device could be employed entirely without a handle 19 and rod extension 20*a*, 20*b*, 20*c* and 20*d*. That is, just using the block 10 itself as disclosed is considerably safer for the hands of the operator with respect to the action of the hammer and still affords the precise and accurate positioning of the nail and resistance against off line nail driving. However, it is most preferred to have a handle of the character described. Thus, at least a portion of said handle preferably angles somewhat outwardly and upwardly of its connection to said block to give ample clearance between the two hands of the operator in hammering a nail in. Likewise, reversed passageways as seen at 21 and 27 may be provided so both left and right handers may use the device most conveniently from either end of the block, such requiring only the release and resetting of two set screws.

In the use of the device by either a left hander or a right hander, depending upon how the sheet tin corrugations lie, it may be necessary or desired to reverse the angle at which the nail penetrates the corrugated sheet and underlying surface, such as a roof or wall. Two straight passageways 21 and 27 have been provided through each side of the block so that either a left hander or a right hander can transfer the handle to the opposite side and reverse the nail inclination angle to that position most needed or desired. This means that any user can have available or utilize both directions of travel across the tin sheet or adapt to both directions of travel of the corrugated tin and have a choice of either angle of inclination the nail (to the right or left).

With respect to FIG. 2, the two handle positions shown in passageways 21 and 27 are those best adapted to a right hander. Normally, a left hander would engage portion 20*d* of the handle rod in passage 27 on the left hand of the block in FIG. 2 and, alternatively, in passage 21 on the right hand of the block in FIG. 2. If the user is not employing a handle as shown in the views of FIGS. 1, 2 and 4, the user merely need reverse the position of the block 10 in his hand not holding the hammer to be able to obtain the most desirable position of the angle slot 31 with respect to the corrugations of the corrugated tin sheet.

As mentioned, the width of slot 31 is preferably no greater than one half the diameter of ball 30. This means that ball 30 can roll freely in the inboard end of passageway 29 and extend a radius length into slot 31. Spring 30*a* is preferably not engaged by ball 30 until the insertion of a nail shank 34*a* has driven ball 30 approximately half a radius into passageway 29. Since the relative diameter of the nail shank 34*a* is not much less than the width of slot 31, ball engaging nail shank 34*a*, as seen in FIGS. 6, 7 and 8, is powerfully spring loaded into the position shown. When block is disengaged from nail shank 34*a* by moving it along the corrugation, away from the viewer in FIG. 8, the passage of the nail shank 34 past the outwardly extending portion of ball 30 further moves ball 30 into passage 29 and further compresses spring 30*a*.

A typical minimum length of the nails employed is $1\frac{1}{2}$ inches to 2 inches. A typical nail shank diameter (preferably a ribbed shank nail) is $\frac{1}{8}$th of an inch. A typical nail head 34b diameter is ⅜ths of an inch or slightly less. Gasket is employed to seal the holes 36c through hills 36a of the corrugations. (36c). These measurements are typical only, not limiting.

The typical distance from corrugation top to adjacent corrugation top (or between adjacent valley bottoms of the corrugated sheet tin) is slightly greater than 1¾ inches. The typical corrugation height from bottom of adjacent valley to top of corrugation hill is approximately ⅛th to 3/16ths of an inch or slightly greater. These dimensions are merely typical, not limiting. Such describes the universal small corrugation tin sheet which is a standard of the industry. Specialty tin of different sizes will require a relatively different size block 10. There are rectangular, ribbed specialty tins which are typically first drilled and then screwed onto a wall or roof. In the event that this device is to be employed with the latter, instead of the accurate bottom 12 illustrated, a rectangular recess centered in the bottom 12 with rectangular (in front view of FIG. 8) side wall portions to lie against the sides of the rectangular ribbed tin would be employed.

With respect to the removable plate which is shown holding or backing up the end of spring 30a, specifically, member 18, as an alternative the passageway 29 could be threaded at its outer end and a threaded flush cap employed with the spring. In such case, the indentation 17 in wall 16 would not be present. As mentioned, spring 30a is short enough so that ball 30 is free in its inward and outward motion in passage 29 until a nail shank is inserted in slot 31 back to the inside wall 31a. That is, ball 30 floats free until it is pinned back by a nail insertion in slot 31 past ball 30 against slot base 31a.

The top recess 32, 33 is almost critical in order to avoid strongly pinning the block 10 by the nail head 34b and/or gasket 37 to the roof. Nevertheless, the block may be advantageously used compared to prior available means without such recess. As seen in FIG. 8, the recess should be sufficiently deep (wall 33) so that both the nail head 34b and gasket 37 (without the latter under any substantial compression) can be received fully within the recess at or below top 11 of block 10.

The ability of ball 30 to rotate because it floats free in passage 29 when there is not a nail shank 34a in slot 31 operates to minimize the wear on any given part of ball 30. This gives longer life to the device before the ball has to be replaced.

It is very important to avoid denting the tin of the roof on the corrugation walls. It is also very important to avoid nailing in the valleys of the tin sheet, where leaks most typically appear, as substantially all of the water, snow, etc. gets into the corrugation valleys first.

Any spring 30a strong enough to hold the nail shank 34a in a satisfactory manner will make the snap-in of the nail difficult if it were to be full length where ball 30 would be held thereby out against the opposite wall of slot 31. Thus, spring 30a preferably is short by about half a radius with respect to ball 30 in passage 29 when ball 30 has rolled out enough to engage the far wall of slot 31.

Reasons for angling of the nail 34 to achieve best securement are: (1) wind, (2) vibration of the structure after finishing, typically due to vibration of vehicles passing, (3) the nails will pull out much more easily if they are driven straight in (one wants to go through different fibers in the wood from soft to hard grain), and (4) the typical overloading of barns by overstacking materials therein. If one has a series of angled driven nails along the lengths of the corrugations as well as laterally from corrugation to corrugation, there is far less chance that vibration and wear will ultimately pull the nails out of the wood.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A device for aiding nailing of nails through the top or peak portions of the corrugations of a corrugated sheet into a supporting surface under said sheet, said corrugated sheet having spaced apart, adjacent corrugations made up of substantially parallel hill portions separated each from the other by a valley therebetween, adjacent valleys also extending substantially parallel to one another, comprising, in combination:

(1) an integral metallic block having a top all and an opposing bottom wall with two side walls positioned substantially opposite one another and front and rear end walls positioned substantially opposite one another, said end walls and side walls being positioned at substantial right angles to one another, all of said walls being substantially rectangular in shape, (2) the bottom wall being symmetrically inwardly and outwardly formed from the side walls to the substantial center thereof, thereby forming an accurate, elongate channel extending between and out of each of said end walls, whereby said bottom wall will closely overlie and fit over and onto the hill portion of any corrugation of a corrugated sheet with the side portions of said bottom wall and bottom portions of said side walls being received well down in the valley portions on each side of said overlaid corrugation hill portion, (3) a slotted passageway extending substantially vertically through said block from substantially centrally of said top wall to substantially centrally of said bottom wall in the upwardly formed central portion of the latter wall, said slotted passageway extending in its entire length normally substantially vertically through said block and substantially vertically out of one end wall of the said block, whereby to enable a nail shaft to be inserted in said passageway in a normally substantially vertical position, (4) said slotted passageway adapted to receive the shank of a nail therewithin and therethrough in normally substantially vertical position and means associated with said slotted passageway intermediate the ends thereof for resiliently engaging a portion of the side of the shank of a nail, whereby to resiliently and releasably retain said nail in said passageway for driving of said nail into and through a hill portion of said corrugations and thereafter into said supporting surface under said sheath.

2. A device as in claim 1 wherein said slotted passageway slants at an angle of approximately 6° from the vertical in its entire extension through said block.

3. A device as in claim 2 wherein said slotted passageway slants at an angle of approximately 6° from the vertical in its extension through said block and the lower end of said passageway exits from said block lower wall centrally thereof, as well as from said block top wall somewhat off center thereof.

4. A device as in claim I including a recess in the top wall of said block surrounding said slotted passageway adapted to receive the head of a nail and any gasket associated therewith, after said nail is partially driven into said corrugated hill portion and the supporting surface therebeneath.

5. A device as in claim 1 wherein a handle is provided removably attached to one end wall of said block, said handle extending substantially axially with respect to said channel in said block.

6. A device as in claim I wherein two parallel, but opposed and laterally spaced apart, passages are provided, (through said block end wall to end wall thereof on opposed sides of said block) one extending into each end wall of said block in substantial axial extension with respect to said channel, whereby to alternatively permit engagement of each end of each said passageway by a handle means.

7. A device for aiding nailing of nails through the top or peak portions of the corrugations of a corrugated sheet into a supporting surface under said sheet, said corrugated sheet having spaced apart, adjacent corrugations made up of substantially parallel hill portions separated each from the other by a valley therebetween, adjacent valleys also extending substantially parallel to one another, comprising, in combination:

(1) an integral metallic block having a normally substantially horizontal top wall and a bottom wall, said bottom wall positioned in substantial opposition to said top wall, there also being at least one normally substantially vertical, circumferential side wall connecting the peripheral edges of the top and bottom walls to one another.

(2) the bottom wall being symmetrically inwardly and upwardly formed from opposed portions of said side wall inwardly to the substantial center thereof, thus to form an inverted channel, whereby said formed, channeled, bottom wall will closely overlie and fit over and onto the hill portion of a corrugation of a corrugated sheet with the side portions of said bottom wall not substantially inwardly formed being received well down in the valley portions on each side of said overlaid corrugation hill portions (3) a slotted passageway extending substantially vertically through said block from substantially centrally of said top wall to substantially centrally of said bottom wall in the inwardly and upwardly formed portion of said bottom wall, said slotted passageway extending in its entire length normally substantially vertically through said block and substantially vertically out of one portion of the bottom wall of said block in substantial alignment with the central axis of said bottom wall channel.

(4) said slotted passageway adapted to receive the shank of a nail therewithin and therethrough in normally substantially vertical position,

(51 ) means associated with said slotted passageway intermediate the ends thereof for resiliently and removably engaging a portion of the side of the shank of a nail, whereby to resiliently and releasably retain said nail in said passageway for driving of said nail into and through the hill portion of a corrugation and thereafter into said supporting surface under said sheet.

8. A device as in claim 7 wherein said slotted passageways slants at an angle of approximately 6° from the vertical in its entire extension through said block.

9. A device as in claim 7 including a recess positioned in the top wall of said block surrounding said slotted passageway, said recess adapted to receive the head of a nail positioned in said passageway and any gasket associated therewith, when said nail (partially) is fully driven into said corrugated sheet hill portion and said supporting surface therebeneath.

10. A device as in claim 7 wherein two substantially parallel passages are provided, each extending at least substantially into said block, (side wall portion to side wall portion thereof) each aligned substantially parallel to the axis of said bottom wall channel, said passages opening out of (on) opposed side portions of said block laterally spaced from one another, whereby to permit engagement, alternatively, of each end of (each said passageway) said block by a handle means.

* * * * *